US005888083A

United States Patent [19]

Seilhan et al.

[11] Patent Number: 5,888,083

[45] Date of Patent: Mar. 30, 1999

[54] MINIATURE UNDERWATER CONNECTOR

[75] Inventors: Denton S. Seilhan, San Diego; Donald F. Pepper, Carlsbad, both of Calif.

[73] Assignee: Brantner & Associates, Inc., El Cajon, Calif.

[21] Appl. No.: 859,054

[22] Filed: May 20, 1997

[51] Int. Cl.[6] ..... H01R 13/20

[52] U.S. Cl. ..... 439/161; 439/680

[58] Field of Search ..... 439/161, 680

[56] References Cited

U.S. PATENT DOCUMENTS

| | | | |
|---|---|---|---|
| 2,703,870 | 3/1955 | Minto | 439/205 |
| 3,963,297 | 6/1976 | Panek et al. | 439/204 |
| 4,053,201 | 10/1977 | Grappe | 439/589 |
| 4,304,456 | 12/1981 | Takaki et al. | 439/204 |
| 4,305,636 | 12/1981 | Jackson et al. | 439/204 |
| 4,346,954 | 8/1982 | Appling | 439/201 |
| 4,553,807 | 11/1985 | Cane | 439/272 |
| 4,795,375 | 1/1989 | Williams | 439/680 |
| 4,801,277 | 1/1989 | Seilhan | 439/680 |
| 4,880,390 | 11/1989 | Brackmann, Jr. et al. | 439/204 |
| 4,940,416 | 7/1990 | Wagaman et al. | 439/204 |
| 5,171,158 | 12/1992 | Cairns | 439/199 |
| 5,395,246 | 3/1995 | Punako et al. | 439/680 |

OTHER PUBLICATIONS

Product Catalog, Brantner And Associates, Inc. (1991), "Mini–Con Miniature Underwater Connectors."

*Primary Examiner*—Steven L. Stephan
*Assistant Examiner*—T. C. Patel
*Attorney, Agent, or Firm*—Knobbe, Martens, Olson, & Bear, LLP

[57] ABSTRACT

An underwater electrical connector includes a plug shell, a receptacle shell, and removeable inserts. A substantially water tight seal is provided between the plug and receptacle shells when engaged, and preferably the plug shell and the socket shell have a maximum diameter of less than approximately 0.75 inches. In some embodiments, the plug and receptacle inserts are held in place with retaining rings comprising a shape-memory alloy. A low profile key having one portion flush with a shell surface may be provided, as well as an optional insert mounted oil valve.

27 Claims, 10 Drawing Sheets

MINIATURE UNDERWATER CONNECTOR

FIELD OF THE INVENTION

The present invention relates to connectors suitable for use in an underwater environment. More particularly, the present invention has particularly advantageous application to modular underwater connectors with removeable inserts.

BACKGROUND OF THE INVENTION

For several decades, there has been an ever increasing demand for quality underwater connectors. During the 1960s, this demand was pushed by military and commercial oil exploration ventures during what is sometimes known as the "golden age" of manned undersea vehicle research, development, and operations. The market for undersea connectors again experienced growth during the mid-1970s when the United Kingdom and Norway began actively exploiting the vast oil reserves under the North Sea. Today, underwater connectors are still used extensively in ocean related military applications, including submarines and other mobile vehicle applications, in underwater research and exploration activities, in ocean mining, and in offshore oil production.

In the design of underwater connectors, several environmental parameters must be considered. The most serious consideration is of course the exposure to extremely high water pressures, which can reach about 20,000 psi at deep ocean operating depths. These pressures can crush or otherwise deform connectors which are not properly designed to withstand such pressures. High pressure watertight seals must also be provided, as water ingress may lead to short circuiting of any electrical contacts inside the connector. Connector materials in contact with a salt water environment should also be corrosion resistant. Connectors must thus be designed to withstand the extreme external pressures, and also provide a sufficient seal to prevent water ingress.

In addition to the above-described characteristics, the development of more sophisticated underwater electrical apparatus has created a need for connectors of small size and high contact density that has not been adequately filled prior to the present invention. As connectors get smaller, many design difficulties arise. Thinner material cannot withstand as high a pressure. Small components of such connectors become more difficult to manipulate, increasing the incidence of connector and wiring damage during connector assembly and use. More complex moving parts such as oil valves, which are often desirable components of underwater connectors, may not fit in a connector with a small cross-section.

Although the undersea connector industry has made great strides from the experience in undersea exploration during the latter half of the 20th century, some applications continue to demand smaller and smaller connectors. However, because of the various structural impediments to reducing connector sizes, the industry has been slow to advance, and has continued to utilize connectors which are larger than is desirable. Accordingly, there is a need for a miniature undersea electrical connector able to withstand high pressures, which is easy to assemble and use, and which can incorporate a high density of electrical contacts.

SUMMARY OF THE INVENTION

The present invention includes underwater connectors of advantageously small sizes. In some embodiments, the connectors comprise plug and socket shells, and plug and socket inserts. The inserts may be retained in the shells with retainers formed at least in part from a shape-memory-alloy. Furthermore, the plug and socket shells may both comprise diameters of less than approximately 0.75 inches. Another aspect of the present invention includes a connector for underwater use comprising first and second mateable shells, wherein at least one of the shells comprises an insert contained substantially within the shell, and a retainer comprising shape-memory alloy holds the insert within the shell. Another aspect of the present invention comprises a plug shell for an underwater connector having a shell body with a contoured outer surface and a key defining a flat surface on the contoured outer surface. Preferably, the flat surface is substantially tangential to a point on the contoured outer surface.

Another aspect of the present invention includes simple and compact oil valves for underwater connector use. Accordingly, in one embodiment, an underwater connector comprising a shell and an insert retained inside the shell is provided. The insert further comprises a throughbore having a threaded section proximate its rear end and an externally threaded sleeve within the throughbore which is threadably engaged with the threaded section of the throughbore. Within the throughbore is a valve body having an O-ring attached thereto, and a spring is captured by and extends between the valve body and the threaded sleeve. Additionally, the throughbore includes a tapered portion, and the spring biases the valve body toward the front end of the insert so as to seat the O-ring against the tapered portion.

DESCRIPTION OF THE PREFERRED EMBODIMENTS

Preferred embodiments of the present invention will now be described with reference to the accompanying figures, wherein like numerals refer to like elements throughout. The terminology used in the description presented herein is intended to be interpreted in its broadest reasonable manner, even though it is being utilized in conjunction with a detailed description of certain specific preferred embodiments of the present invention. This is further emphasized below with respect to some particular terms used herein. Any terminology intended to be interpreted by the reader in any restricted manner will be overtly and specifically defined as such in this specification.

Figure 1A:
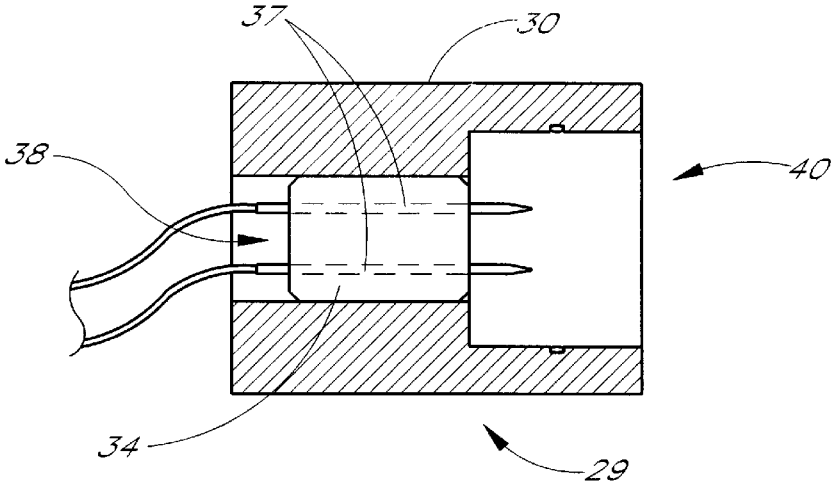
FIG. 1*a* is a cross sectional view of a connector receptacle portion illustrating several fundamental components of an underwater electrical connector of the present invention.
Figure 1B:
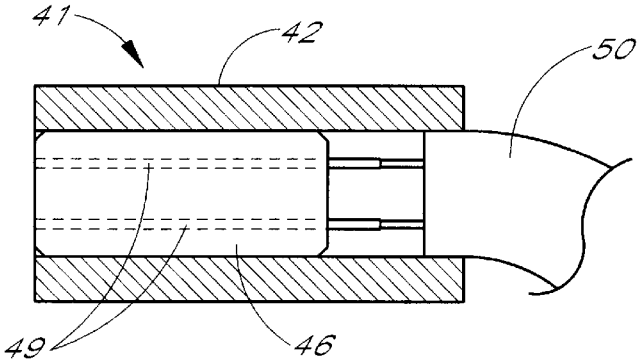
FIG. 1*b* is a cross sectional view of a connector plug portion illustrating several fundamental components of an underwater electrical connector of the present invention.
Figure 1C:
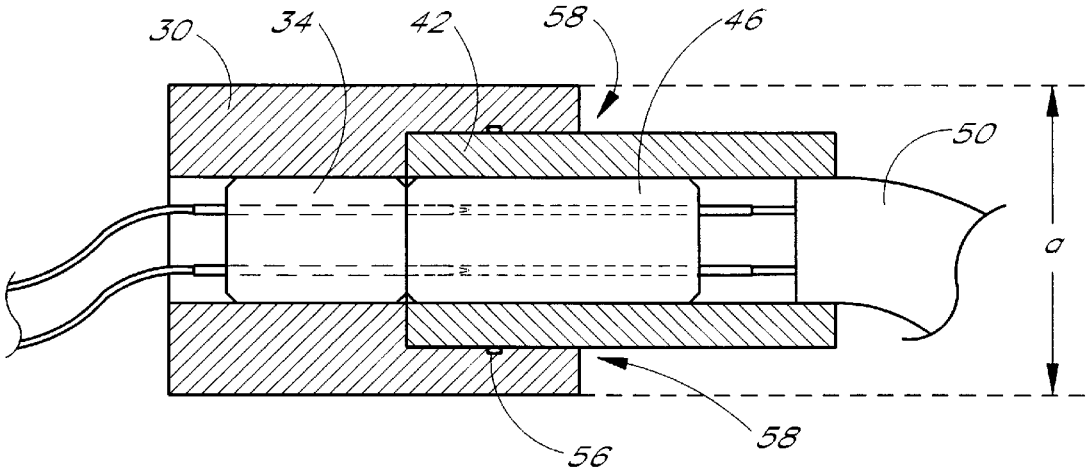
FIG. 1*c* is a cross sectional view of the connector plug portion of FIG. 1*b* installed into the connector receptacle portion of FIG. 1*a*.

Connectors for underwater use may be manufactured in several different styles. To illustrate several fundamental features of underwater connectors according to some embodiments of the present invention, a cross sectional view of a very simple version of an underwater connector is provided in FIGS. 1*a*–1*c*. In conjunction with these Figures, several aspects of connector assembly and basic protections against water ingress are set forth. It will be appreciated by those of skill in the art that for clarity of explanation, only certain features of underwater connectors are illustrated in FIGS. 1*a* to 1*c*. FIGS. 1*a* to 1*c* are thus intended to show with clarity several fundamental aspects of preferred connector according to the present invention. Additional features of underwater connectors in accordance with preferred embodiments of the present invention are shown and described with reference to FIGS. 2 through 11.

FIG. 1*a* illustrates a connector receptacle portion 29. The receptacle portion 29 comprises a receptacle shell 30 which may be configured to mount to an orifice in a bulkhead wall provided as part of a piece of underwater electrical equipment. Bulkhead securement methods, although not illustrated in FIGS. 1*a*–*c*, are shown and described in detail with reference to FIGS. 3, 5, and 8, and the discussion accompanying these Figures below.

Inside the receptacle shell 30 is a receptacle insert 34, which slides into the receptacle shell 30 either from the low pressure rear side 38 of the receptacle shell 30 or alternatively from the high pressure front side 40 of the receptacle shell 30. The receptacle insert 34 may be retained inside the receptacle shell 30 in a variety of ways, some of which are described in more detail below with reference to additional connector embodiments. Pins 37 extend through the receptacle insert 34, and connect to wiring on the opposite side of the receptacle portion of the connector, which typically opens into the internal portion of a piece of electrical or electronic apparatus that is intended for underwater use.

FIG. 1*b* illustrates a connector plug portion 41. The connector plug portion 41 comprises a plug shell 42, which also houses a plug insert 46. As with the receptacle shell 30 and receptacle insert 34, the plug insert 46 may be designed to load from either side of the plug shell 42 and may be retained in the plug shell 42 in a variety of ways. Sockets 49 extend through the plug insert 46 and connect to a cable 50 which exits the rear of the plug shell 42.

The receptacle and plug portions of the connector may thus be characterized as modular, in that inserts having a variety of configurations may be alternatively provided in the receptacle and plug shells. Different configurations may include different numbers of pins and sockets, different pin and socket size for different wire gauges, different pin and socket layout, etc. After insertion, the inserts are held in place with one or more removeable or releasable retainers (not illustrated in FIGS. 1*a*–*c*) so that the insert can be removed or replaced if desired. These retainers may take many forms, including, for example, separately installed rings, or structures integral to the receptacle shell 30 and/or receptacle insert 34 itself. The term "retainer" is therefore intended to include within its scope any device or shell/insert design feature which functions to hold an insert inside a connector shell. One advantage of such modularity is in flexibility of connector manufacture, as well as field modification. The shells 30, 42 are advantageously made from a strong metal material which is resistant to corrosion, such as titanium. The inserts 34, 46 preferably comprise an insulating material such as glass reinforced epoxy.

FIG. 1*c* illustrates the receptacle portion 29 and plug portion 41 of the connector mated together, with the pins 37 and sockets 49 in contact to establish an electrical connection. Preferably, a substantially water-tight seal is provided at the interface between the receptacle shell 30 and the plug shell 42. This helps to prevent excessive water leakage (in the general direction of the arrows 58 of FIG. 1*c*) into the electrical connection formed when the connector portions 29, 41 are mated. One convenient method to form such a water-tight seal is with the use of an O-ring 56 which seats in a groove in one of the shells. Other methods, such as various potting or encapsulation methods may also be utilized to form such a seal. A connector may thus be considered to include a seal if one or more features allow for underwater functionality. Most preferably, the connector construction, including the water-tight seal, allows connector use at pressures of at least 2000 psi, and more preferably pressures of at least 13,500 psi. Some advantageous embodiments withstand external water pressures of at least 20,000 psi.

Additional water-tight seals not shown in FIGS. 1*a* to 1*c* may be provided. For example, when the receptacle shell 30 is bulkhead mounted, a seal is preferably provided where the receptacle shell 30 contacts the bulkhead. Those of skill in the art will also recognize that additional sealing should be provided where the cable 50 attaches to the plug portion 41 of the connector. Several methods may be utilized, including over-molding solid plastic over the junction, or using field installed boots which are secured to the cable 50 and to the plug shell 41 respectively with cable ties or hose clamps. Additional seals (not shown in FIGS. 1*a*–*c*) may also be provided between each insert 34, 46 and their respective shells 30, 42. Sealed modular underwater connectors with removeable inserts are also described in U.S. Pat. Nos. 4,801,277, which is assigned to the assignee of the present invention. The disclosure of the 4,801,277 patent is hereby incorporated by reference in its entirety.

One inventive aspect of the connector of FIGS. 1*a*–1*c* is its small size. In some advantageous embodiments, the maximum connector dimension "a" is less than about 0.8 inches. In other advantageous embodiments, the maximum connector dimension "a" is less than about 0.6 inches. Modular underwater connectors of this size have not been contemplated prior to the present invention. For one thing, keyways which are used to align the inserts during connector assembly and installation create weak spots in a shell wall which can rupture in deep ocean applications. In addition, insert retainers for such small connectors are very difficult to work with. Removal can easily damage the insulation or break fine wiring routed to the connector contacts. As is explained in detail below, both of these problems are solved in the present invention, thus enabling the production and use of very small underwater connectors.

It will be appreciated that many alternative embodiments of the connectors illustrated in FIGS. 1*a*–1*c* may be made without altering their important characteristics. For example, either shell 30, 42 may comprise an insert with pins 37, whereby the other shell 42, 30 would comprise the mating insert with sockets 49. Other forms of creating electrical continuity inside the connector housing may also be utilized. Furthermore, non-electrical interfaces, such as single or multi-mode optical fiber connections can also be created using the principles of the present invention. The terms "connector", "contact", "plug", "receptacle", and the like are therefore not intended to be limited to only electrical interfaces or only to the specific interface implementation of the preferred embodiments described herein.

Figure 2:
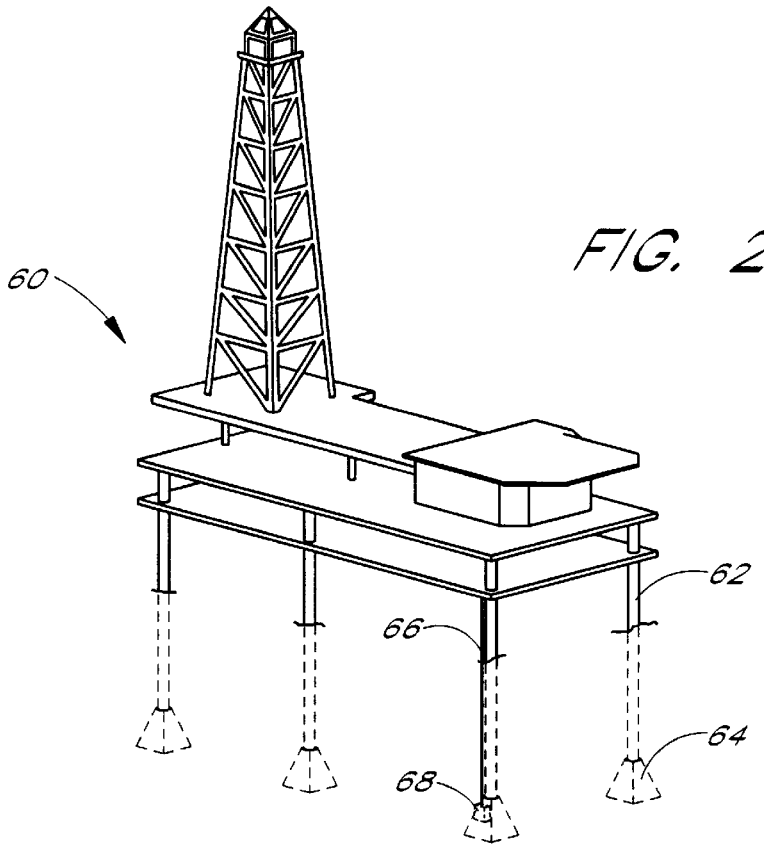
FIG. 2 is a schematic perspective view of an off-shore oil platform illustrating support legs in phantom.

In FIG. 2, a schematic view of an offshore oil platform 60 is shown to illustrate one environment in which connectors embodying the present invention may advantageously be utilized. The platform 60 includes a plurality of support legs 62 which extend underwater to mounting feet 64 located on the sea bed. There is often a need for remote operating or sensing equipment close to the sea bed or in other locations underneath the oil platform 60. In the illustrated embodiment, one or more cables 66 extend down one of the support legs 62 to a remote fixture 68. The fixture 68 encloses electronic equipment which is sealed from the surrounding water. The fixture 68 thus typically comprises metal side walls, one or more of which form bulkheads on which electrical connectors are mounted to route signals and/or power between the fixture 68 and other locations on the oil platform 60.

Figure 3:
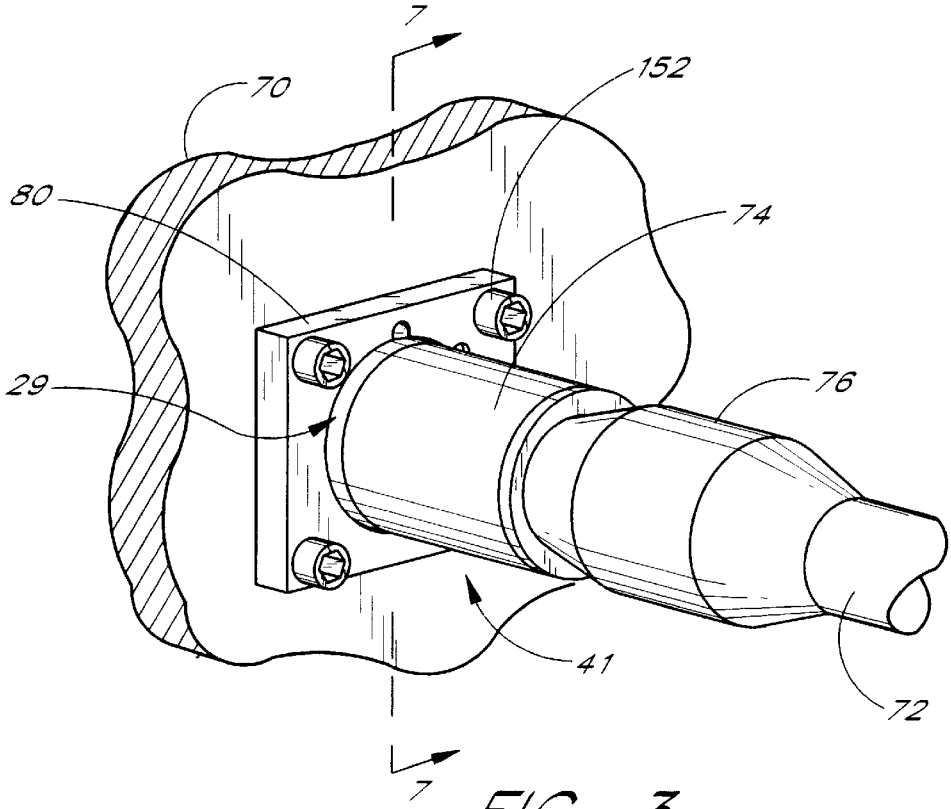
FIG. 3 is a perspective view of one preferred embodiment of an underwater connector of the present invention attached to a bulkhead.

Referring now to FIG. 3, an electrical connector according to one embodiment of the present invention is shown mounted to an exterior surface of a bulkhead 70. A cable 72 attaches to the connector for signal routing into and out of the fixture 68 (FIG. 2) as described above. As with the connector illustrated in FIGS. 1*a*–1*c*, the connector includes a cable connected plug portion 41 and a receptacle portion 29 which is mounted to the bulkhead 70 with a portion extending through the bulkhead 70 into the fixture 68. In many preferred embodiments, the connector receptacle portion 29 and plug portion 41 incorporate removeable inserts and a water-tight seal between the receptacle shell and plug shell as described above in conjunction with FIGS. 1*a*–1*c*. The plug portion 41 is secured to the receptacle portion 29 with an internally threaded sleeve 74, as will be explained in detail below.

The cable 72 and plug 41 junction may be overmolded with a watertight shield 76, formed from, for example, neoprene, polyurethane, or polyethylene, to substantially prevent water leakage into the rear portion of the plug shell. As will be appreciated by one of skill in the art, many alternative cable termination schemes may be used. In some cases, a kevlar strength member in the cable 50 is secured to the inside of the connector. Alternatively, other forms of internal potting may be provided, and field installed boots or sleeves may be used. In addition, an oil-filled cable and connector configuration can be provided wherein the cable comprises a flexible jacket which is typically secured around the rear portion of the connector plug portion with a hose clamp. A hole (not shown) in the connector is used to inject oil into the rear housing of the plug shell to fill the connector and the cable jacket with oil. The hole in the plug shell 42 is then filled with a screw. These and other alternatives for sealing the cable 50 to the connector plug portion 41 are well known to those of skill in the art and are not described in further detail herein.

The receptacle portion 29 of the connector illustrated in FIG. 3 is affixed to the bulkhead 70 with a screw secured flange 80. In alternative embodiments, the receptacle portion 29 is threaded into a tapped hole in the bulkhead 70. The flange 80 is preferably a separate removeable part, as will be explained in more detail below with reference to FIGS. 5 and 8.

Figure 4:
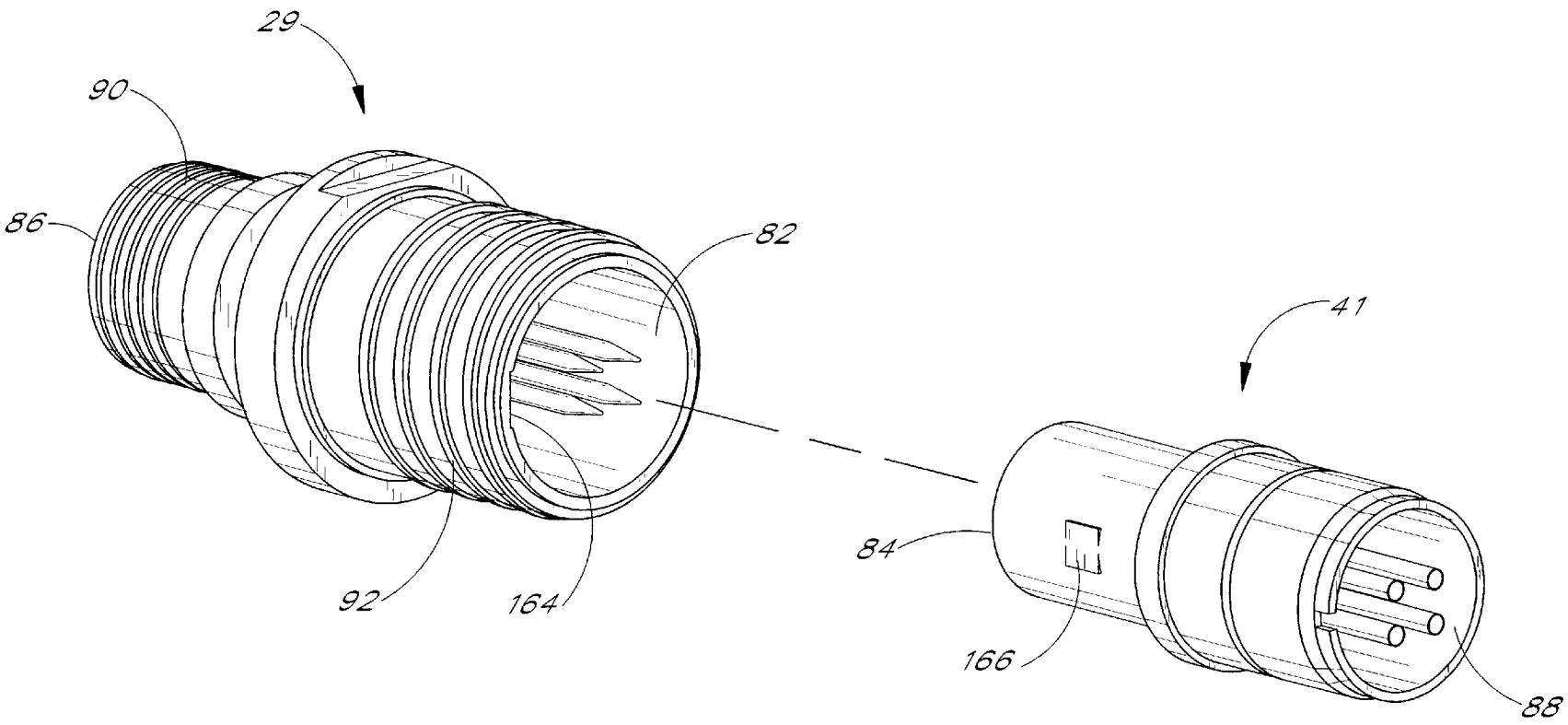
FIG. 4 shows the plug and receptacle portions of the connector of FIG. 3 disengaged and removed from the bulkhead.

FIG. 4 illustrates the plug and receptacle shells disengaged from one another and separated from a bulkhead wall. For purposes of orientation, the respective directions used in the present discussion may be described with reference to this Figure. As has been discussed above, the underwater connector comprises a receptacle portion 29 and a plug portion 41. The receptacle portion 29 may be attached to the bulkhead 70, as seen in FIG. 3. The plug portion 41 would then engage to the end of the receptacle portion 29 extending outward from the bulkhead 70. For purpose of this discussion, the orientation directions of the receptacle portion 29 and the plug portion 41 are oppositely oriented, with their "front" ends 82, 84 mating at an interface, and their "rear" ends 86, 88 on the opposite sides.

The rear end 86 of the receptacle shell may comprise threads 90 for securement in a tapped bulkhead wall or for engagement of a bulkhead nut to secure the receptacle portion 29 to a bulkhead wall 70 (FIG. 3). The front end 82 of the receptacle shell may also comprise threads 92 for engagement with an internally threaded engaging nut (shown in FIG. 7) which secures the plug portion 41 to the receptacle portion 29. The rear end 88 of the plug portion 41 is adapted to receive the cable 50 (FIG. 1*c*), and will be overmolded, booted, or otherwise sealed in actual use, as shown in FIG. 3.

Figure 5:
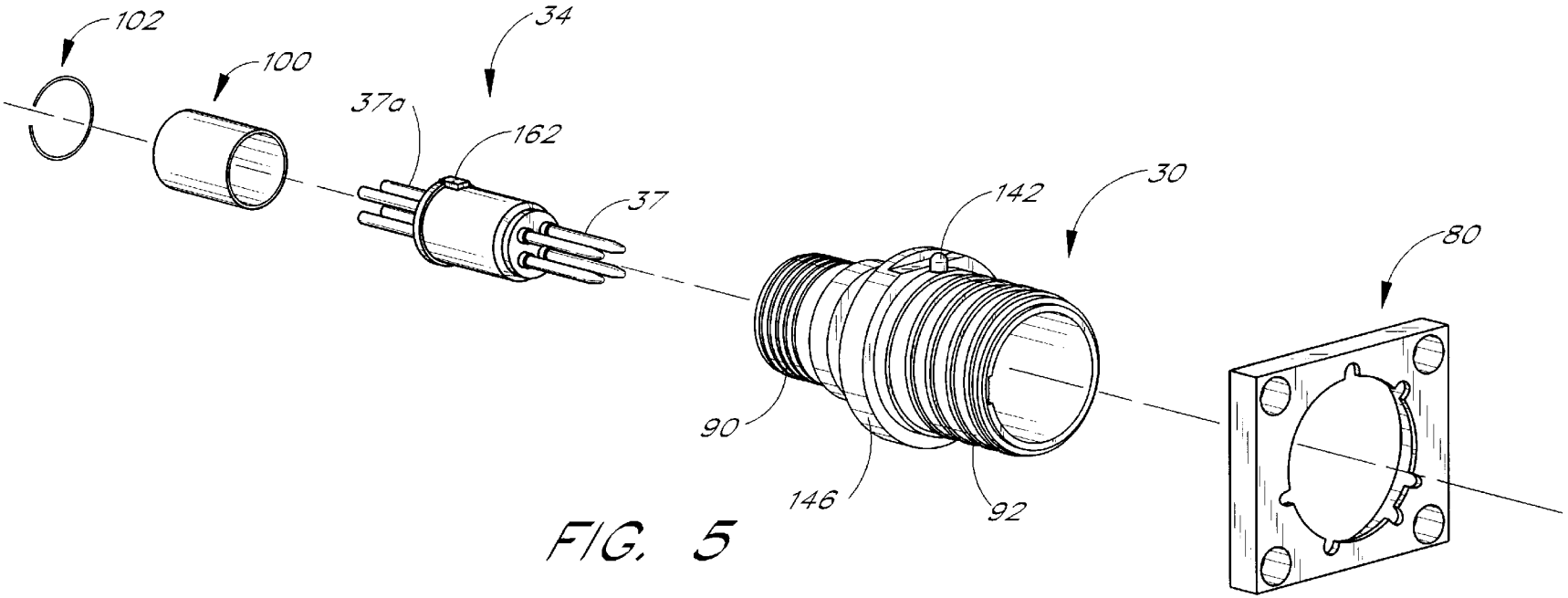
FIG. 5 shows an exploded view of the connector receptacle portion of FIG. 4.

The receptacle portion 29 of the connector is seen exploded in FIG. 5. As is also shown in FIG. 1, the receptacle portion 29 comprises a receptacle shell 30, and a receptacle insert 34. In the embodiment of FIG. 5, a spacer sleeve 100, and a split retaining ring 102 for securing the insert 34 inside the shell 30 are also provided. The insert 34, sleeve 100, and retaining ring 102 fit within the generally cylindrical channel formed within the receptacle shell 30. In addition, the aforementioned electrical contact pins 37 are seen projecting from both ends of the insert 34. As was mentioned above with reference to FIG. 3, the receptacle shell 30 may advantageously be configured for bulkhead mounting either with threads 90 or with a removeable flange 80. The removeable flange 80 fits over the threads 92 on the front of the receptacle shell 30 until it abuts the front surface of an integral collar 146 provided on the receptacle shell 30. Securement of the removeable flange 80 to a bulkhead 70 will thus push the rear surface of the collar 146 against the bulkhead 70 (FIG. 3) and hold the receptacle shell 30 firmly in place in the bulkhead 70.

Prior to the present invention, receptacle shells included either threads 90 on their rear portion, or an integrally formed mounting flange which may, for example, be provided by a much larger integral collar 146 on the receptacle shell 30 which would include mounting holes therein. That is, some receptacle shells could be threaded directly into a tapped hole in a bulkhead, while others would be configured for mounting to the exterior surface of the bulkhead using the integral outer flange and separate fasteners. The present invention combines these two mounting means in a single connector through the use of the detachable mounting flange 80. The mounting flange 80 can be eliminated for directly threaded bulkhead connections, or may be used when the bulkhead orifice is unthreaded. This feature provides increased flexibility to both the user and the connector manufacturer. The user can take the same receptacle shell 30 and either flange or thread mount it to a bulkhead. Furthermore, a manufacturer need not manufacture and stock different receptacle shells for the different bulkhead mounting methods.

Figure 6:
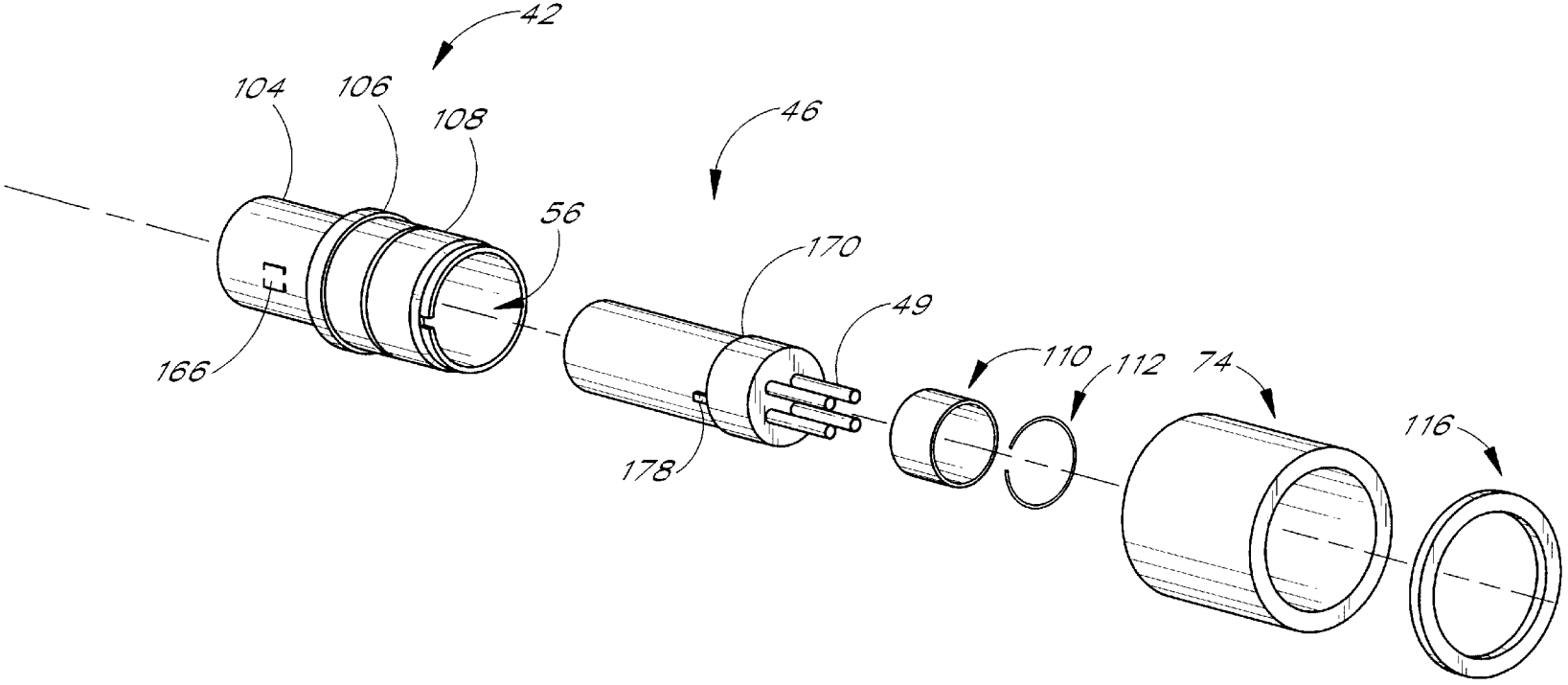
FIG. 6 is an exploded view of the connector plug portion of FIG. 4.

FIG. 6 illustrates the components of a preferred plug portion 41. As is also illustrated in FIG. 1, the plug portion 41 comprises a plug shell 42, and a plug insert 46. In the illustrated embodiment, the plug shell 42 comprises a forward section 104, a collar 106, and a rear section 108, with the collar being larger in diameter than the adjacent sections. In a manner analogous to that used in the connector receptacle portion 29, a spacer sleeve 110, and a split retaining ring 112 are utilized to secure the insert 46 inside the shell 42. As with the receptacle portion 29, the plug insert 46, sleeve 110, and retaining ring 112, also fit within the generally cylindrical channel defined within the plug shell 42. The plug insert 46 includes a plurality of electrical contacts 49 projecting from a rear end which continue through the body of the insert and terminate at the forward end of the insert. The plug portion 41 also preferably includes an internally threaded engaging nut 74 which slides over the plug shell 42 to engage threads on the receptacle shell 30 to hold the two connector halves 29, 41 together. The engaging nut 74 may be held in place on the plug shell 42 with a retaining ring 116.

Figure 7:
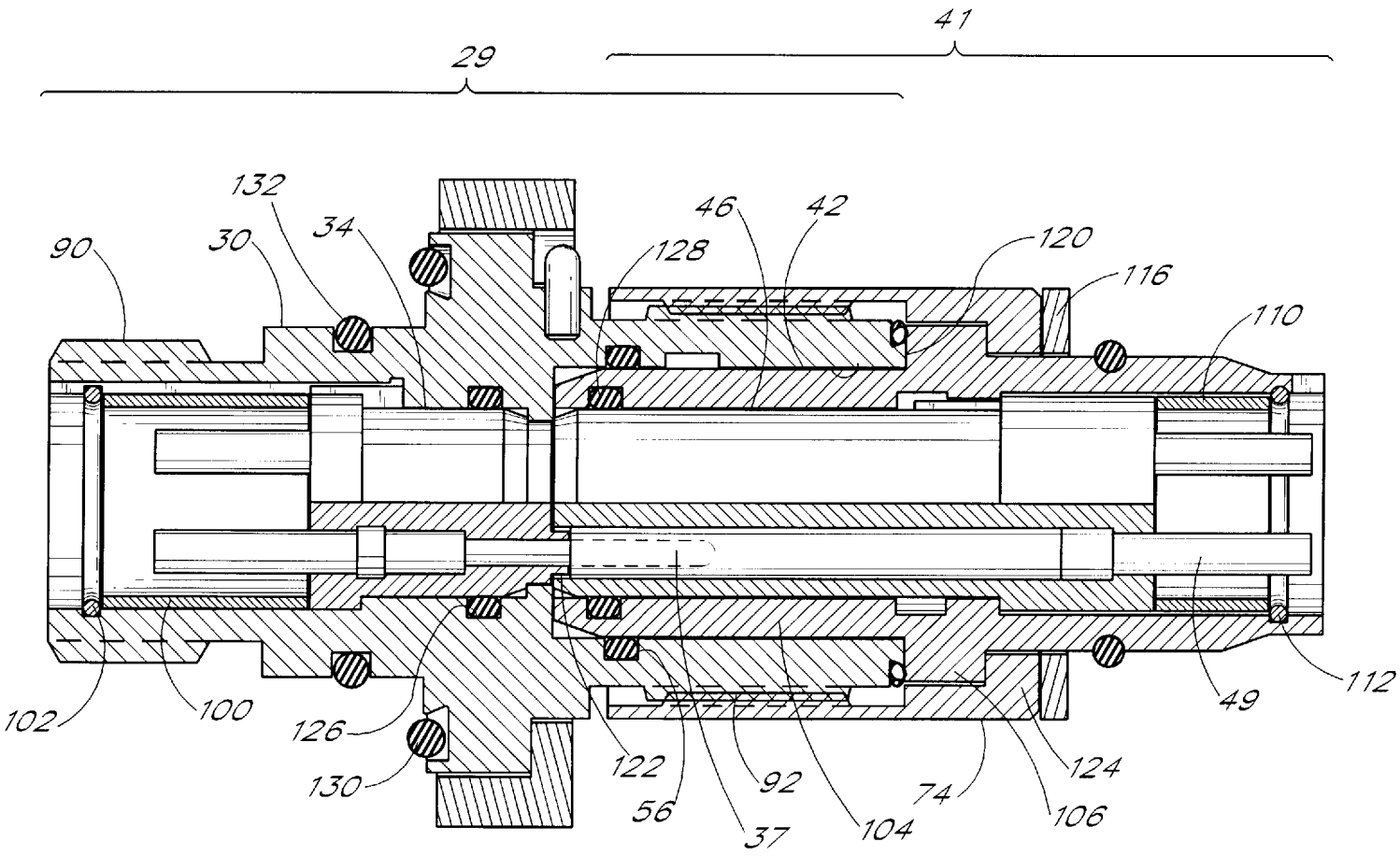
FIG. 7 is a cross-sectional view of the connector plug portion and connector receptacle portions of FIG. 4 engaged to create contact between the pins and sockets of the respective connector portions.

Now with reference to FIG. 7, a completely assembled and engaged electrical connector is shown in cross section. A number of O-rings for sealing the components are shown which were not previously shown in the Figures discussed above. The O-rings are preferably of a conventional elastomeric type used in undersea connectors. In FIG. 7, the forward section 104 of the plug shell 42 is shown inserted within the receptacle portion 29 of the connector. The length of the forward section 104 is determined by the location of the central collar 106, which when coupled to the receptacle portion 29 abuts a forwardmost end 120 of the receptacle shell 30. As seen most clearly in FIG. 7, the pins 37 in the receptacle insert may be made to extend from short pedestals 122 in the front face of the receptacle insert 34. These pedestals 122 seat in mating indentations in the front face of the plug insert 46 to provide rotational support to the mating interface between the two inserts.

After the respective contacts of the receptacle portion 29 and plug portion 41 are engaged, the engaging nut 74 is tightened over the threads 92 on the exterior of the forward section of the receptacle shell 30. The engaging nut 74 advances over the front threaded section 92 of the receptacle shell 30, pushing a rear annular flange 124 against the collar 106 of the plug shell 42, and therefore pushing the plug portion 41 of the connector into the receptacle portion 29 of the connector to mate the pins 37 with the sockets 49. Although not shown in the Figures, the engaging nut 74 may be provided with a plurality of through-holes around its circumference which are located in the engaging nut 74 so that when the plug and receptacle portions are mated, the through holes are positioned between the threads 92 and the collar 106. These holes assist in inspection of connector positioning, and can be used to engage a wrench for easier tightening if desired. Also, the presence of these holes can help to balance the pressure on both sides of the threaded coupling between the receptacle shell 30 and the engaging nut 74.

In some preferred embodiments, O-ring seals are provided in several locations. One O-ring 56 seals the interface between the receptacle shell 30 and the plug shell 42. Both the receptacle portion 29 and the plug portion 41 are also preferably provided with O-ring seals 126, 128 which seal the insert/shell interface. The interface between the bulkhead wall and the receptacle portion 29 is also preferably sealed with O-rings 130, 132.

Figure 8B:
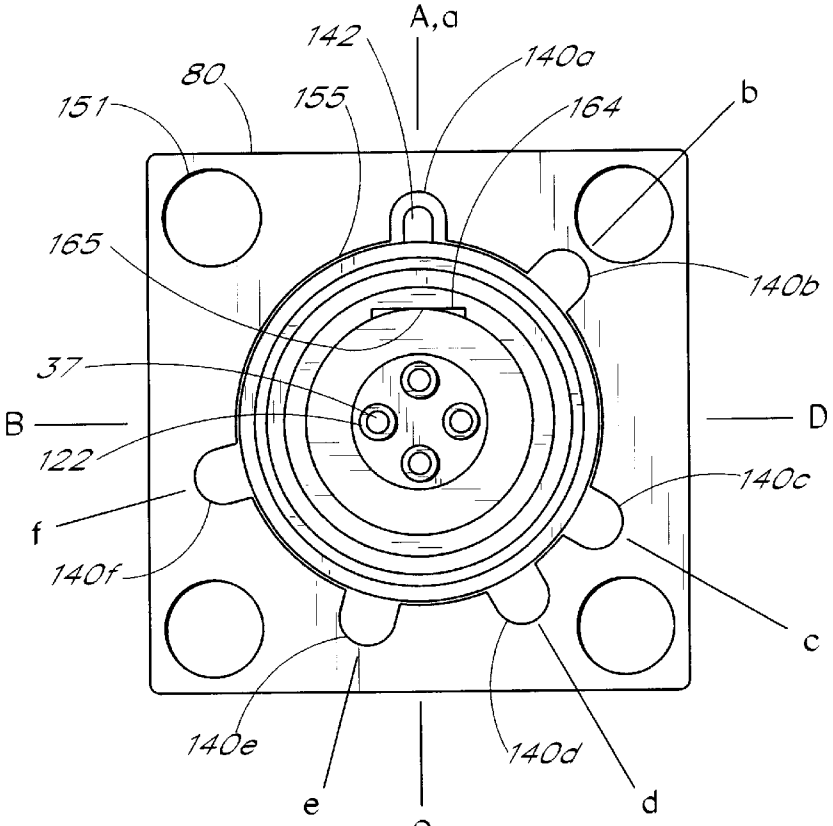
FIG. 8*b* is a front elevational view of the connector receptacle portion of FIG. 8*a*.
Figure 8A:
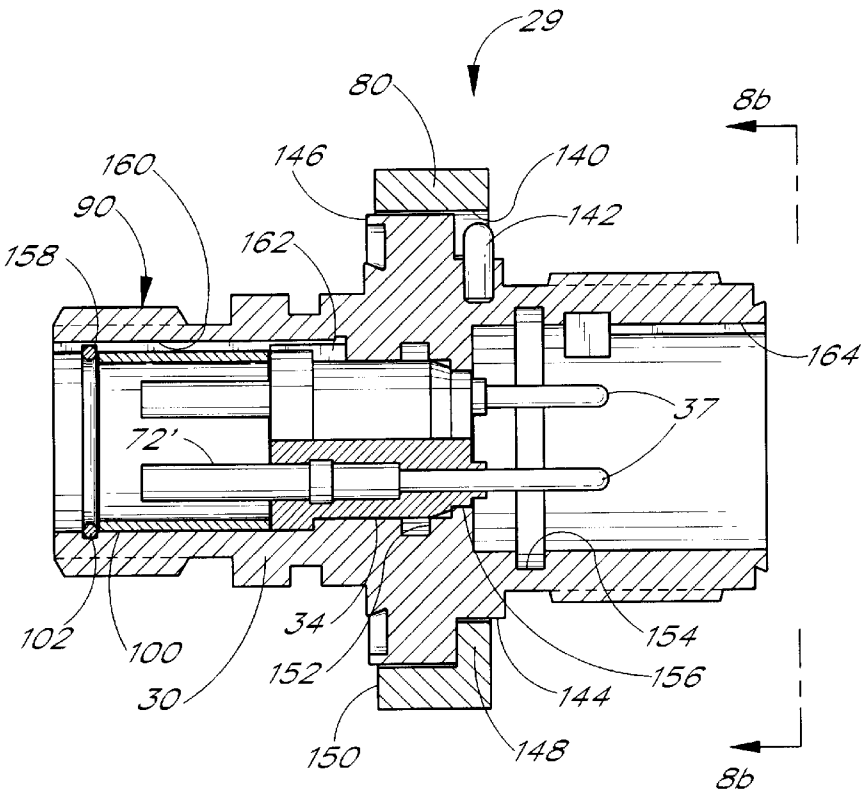
FIG. 8*a* is a cross-sectional view of the connector receptacle portion of FIG. 4.

The receptacle portion 29 and plug portion 41 are now described in greater detail with respect to FIGS. 8 and 9. In FIG. 8*a*, the receptacle portion 29 is shown in cross section and includes the aforementioned shell 30, insert 34, sleeve 100, and retaining ring 102. The mounting flange 80 is also shown in this cross sectional view, illustrating the presence of cutout 140, into which a locating pin 142 extends. The locating pin 142 is preferably press-fit within a hole placed in a circular step 144 formed as a portion of the collar 146 that is integral to the receptacle shell 30. In the lower portion of FIG. 8*a*, a radial wall 148 of the flange 80 is seen abutting against the forward surface of the collar 146. An outer portion 150 of the mounting flange 80 extends rearwardly from the wall 148 and surrounds the collar 146. The function of the locating pin 142 and various orientations of the mounting flange 80 with respect to the receptacle shell 34 are described in more detail below with reference to FIG. 8*b*.

As mentioned, the receptacle insert 34 extends within the generally cylindrical channel in the receptacle shell 30. An annular groove 152 is provided to seat an O-ring (designated 126 in FIG. 7) which seals the insert 34 and the shell 30. Another annular groove 154 is provided to seat a second O-ring (designated 128 in FIG. 7) which seals the receptacle shell 30 and the plug shell 42 when the connector halves are mated.

The receptacle insert 30 is held in place at both the front end and rear end of the receptacle shell 30. The insert 34 and shell 30 may be configured such that the insert is installed from the rear of the shell 30. At the front end, a shoulder 156 prevents further insert motion in a forward direction. The sleeve 100 is inserted into the shell 30 behind the insert 34, and they are held in place against the retaining ring 102. To seat the retaining ring, an annular groove 158 is formed in the rear inside surface of the receptacle shell 30. In some embodiments of preferred connectors, the retaining ring 102 comprises a shape memory alloy.

A shape memory alloy is an alloy which will undergo a thermoelastic martensitic transformation. A transformation of this type involve stress-induced microstructural changes in crystal arrangement which are dominated by coordinated shear displacements of sections of crystal. If the martensitic transformation is thermoelastic, the alloy can in effect be reminded that it "prefers" a different crystal structure with the application of heat, and heat can therefore cause the alloy to return to its original configuration. Some alloys which exhibit this property, albeit not a complete list, include Zn—Al, Cu—Al—Ni, and Ni—Ti.

The retaining ring may thus advantageously be manufactured to have a crystallographically preferred configuration which has a diameter less than that required to be naturally retained tightly within the groove 158. Thus, during installation, the retaining ring 102 is deformed at ambient temperature by pressing it into the groove 158, where it will remain to hold the sleeve 100 and insert 34 inside the shell. To remove the retaining ring, the rear end of the receptacle shell 30 is heated with a heat gun, a flame, or other source of heat to a temperature above the transition temperature of the shape-memory alloy. The retaining ring 102 will then assume its natural shape and pull away from the groove 158, until it is only loosely retained. It can then easily be removed with delicate probing. The retaining ring may alternatively be manufactured to have a crystallographically preferred configuration which allows the retaining ring 102 to drop completely out of the groove 158 upon heating without any user probing at all. The harmful side effects of probing such as marred side wall surfaces are thus avoided.

Referring again to FIG. 8*a*, an axial keyway 160 is formed in the rear of the receptacle shell 30 and receives a key 162 (also visible in FIG. 5) which projects radially outward from the receptacle insert 34. The interface between the key 162 and keyway 160 rotationally orients the receptacle insert 34 within the shell 30. When inserting the insert 34, the key 162 engages the keyway 160 prior to the body of the insert being engaged by the elastomeric O-ring seated in the groove 158. Thus, one can easily orient the receptacle insert 34 with respect to the shell 30 before the movement of the insert 34 is restricted by friction.

A keyway 164 is also formed in the front section of the receptacle shell 30 (also shown in FIG. 4). This keyway 164 receives a similarly shaped key 166 projecting from the exterior surface of the forward section 104 of the cable plug shell 42 (see FIGS. 4, 6 and 9*b*). With examination of FIG. 8*b* it can be seen that one advantageous keyway embodiment has a point 165 in its depth which does not extend beyond the contour of the inside surface of the receptacle shell 30. This minimizes the reduction in shell wall thickness produced by the keyway 164, allowing very small connectors with thin walls to be used under high water pressures even with a keyway present in the shell 30.

FIG. 8*b* also illustrates the detachable mounting flange 80, and the mounting flexibility it provides. In prior art flange mounted receptacle shells, the receptacle shell orientation after mounting was determined by the positioning of the holes in the bulkhead which the flange would be secured to. Referring back to FIG. 3, for example, a prior art flange mounted receptacle portion would be machined to include an integral flange having a hole at each corner for mounting screws in a manner analogous to the connector illustrated in FIG. 3. It can be appreciated that the rotational orientation of such a receptacle portion is limited to four discrete positions, with the positions being defined by the successive 90 degree rotations of the receptacle portion which align the four holes in its integral flange with the four mounting holes in the bulkhead. This may be inconvenient for a user, as more control over the rotational orientation of the contact pattern of the receptacle portion is often desirable. This is especially true when connectors having a right angle plug portion are used. In this case, the exit path for the cable connected to the plug portion must exit in one of only four allowed directions, one direction corresponding to each flange orientation. This can lead to difficulties in routing cables away from the bulkhead in applications having a high density of connectors on the bulkhead surface. As will now be explained, this problem is solved with the detachable flange of the present invention.

With reference now to FIG. 8*b*, the detachable mounting flange 80 may form a substantially square periphery with four mounting holes 151 formed proximate to its four corners for receiving threaded screws or other fasteners. Such fasteners 152 are shown in FIG. 3, attaching the receptacle shell 30 to the bulkhead 70. The mounting flange 80 further includes a central circular aperture 155 which is sized to fit over the front portion of the receptacle shell 30 and abut the collar 146 (FIG. 8*a*) on the receptacle shell 30 with the radial wall 148 of the mounting flange 80. Six rounded cutouts 140*a*, 140*b*, 140*c*, 140*d*, 140*e* and 140*f*, are formed around the circumference of the aperture 155. Specifically, the cutout 140*a* is formed at a 0° orientation as viewed in FIG. 8*b*, the cutout 140*b* is formed at a 45° rotational orientation, the cutout 140*c* is formed at a 120° orientation, the cutout 140*d* is formed at a 150° orientation, cutout 140*e* is formed at a 195° orientation, and the cutout 140*f* is formed at a 255° orientation. These angles are designated, respectively, by the letters a, b, c, d, e, and f in FIG. 8*b*.

Being substantially square, the mounting flange 80 has two major axes perpendicularly disposed, and normal lines A, B, C, D extend from each straight side. Given four threaded holes in the bulkhead 70 which are relatively positioned to match the square configuration of the screw holes 151 in the mounting flange 80, it will be appreciated that there are four such orientations in which the mounting flange 80 may attach to the bulkhead 70. For example, the normal line A can be directly upward, 90° clockwise, 180° clockwise, or 270° clockwise. It can further be appreciated that cutout 140*a* can thus be oriented at 0°, 90°, 180°, or 270°. Also, cutout 140*b* could be oriented at 45°, 135°, 225°, or 315°. With the additional presence of cutouts 140*c*, 140*d*, 140*e*, and 140*f* a cutout may be placed at any of the angular orientations of 0°, 15°, 30°, 45°, 60°, 75°, 90°, 105°, 120°, 135°, 150°, 165°, 180°, 195°, 210°, 225°, 240°, 255°, 270°, 285°, 300°, 315°, 330°, or 345° for a total of 24 different possible cutout orientations at 15° increments around the aperture.

The locating pin 142 extends from the receptacle shell 30, and is sized to fit within one of the cutouts 140*a*, 140*b*, 140*c*, 140*d*, 140*e* or 140*f*. As described above, because the mounting flange 80 can be oriented in four different ways, and there are six different cutouts 140, there are 24 different rotational orientations of the locating pin 142 which the mounting flange 80 can accommodate. Thus, if the desired receptacle shell 30 orientation within the bulkhead is such that the locating pin 142 extends in a direction of 270° from the 0° orientation, the mounting flange 80 is aligned with the receptacle shell 30 so that the cutout 140*a* fits over the locating pin 142, thus securing the receptacle shell in its desired orientation. Alternatively, if the desired receptacle shell 30 orientation within the bulkhead is such that the locating pin 142 extends in a direction of 60° from the 0° orientation, the mounting flange 80 is aligned with the receptacle shell 30 so that the cutout 140*c* fits over the locating pin 142. Of course, more or less than six cutouts 140 may be formed in the mounting flange 80, and the cutouts may be provided at different angles than those specifically illustrated. It has been found, however, that the present combination of 24 different possible orientations of the receptacle shell 30 with respect to the bulkhead 70 provides orientation flexibility suitable for many common applications.

Figure 9A:
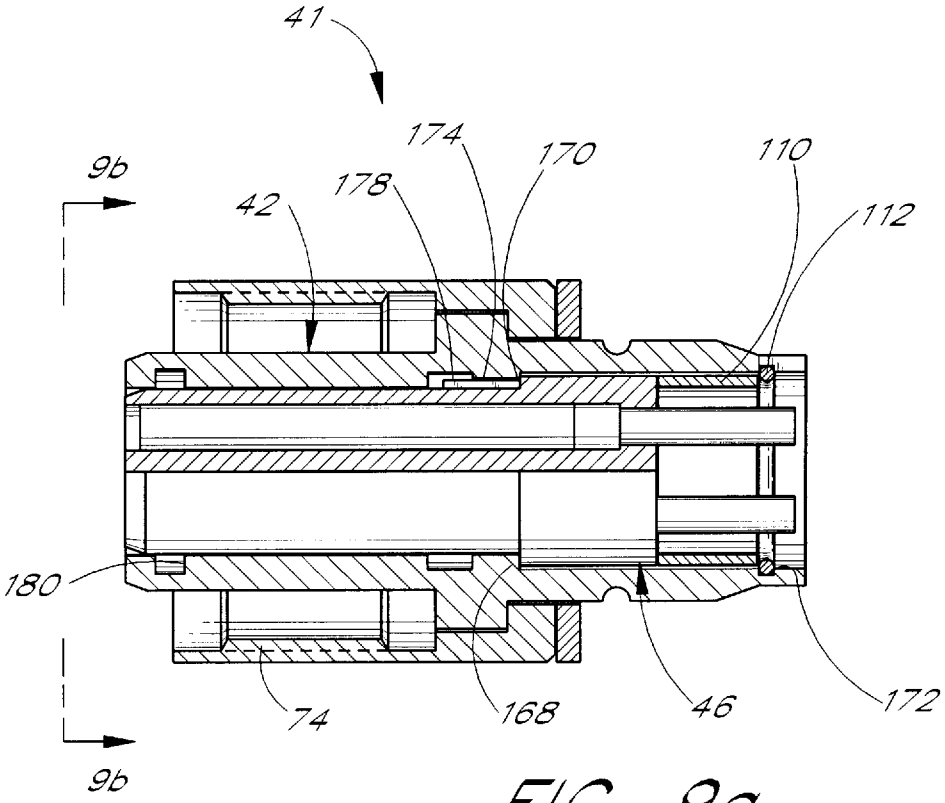
FIG. 9*a* is a cross-sectional view of the connector plug portion of FIG. 4.
Figure 9B:
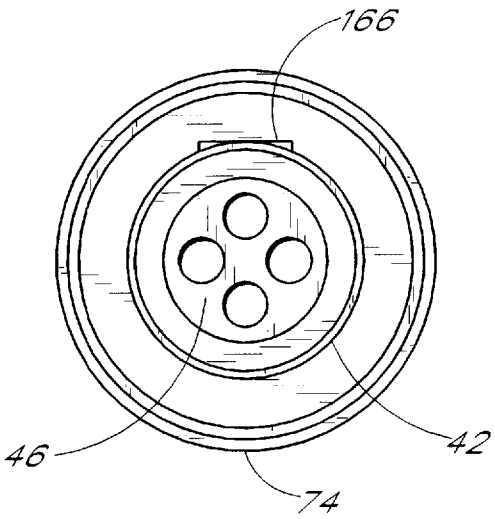
FIG. 9*b* is a front elevational view of the connector plug portion of FIG. 9*a*.

Referring now to FIGS. 9*a* and 9*b*, the details of the plug portion 41 will be described. The plug shell 42 forms a generally cylindrical cavity which includes a shoulder 168. The shoulder 168 provides a stop for a shoulder 170 (also shown in FIG. 6) which is formed on the plug insert 46. The plug insert 46 may advantageously be inserted into the plug shell from the rear end thereof. In a manner analogous to the receptacle portion 29, the spacer 110 fits between the fully seated plug insert 46 and a circumferential groove 172 which receives the retaining ring 112. The retaining ring 112 thus axially retains the plug insert 46 within the plug shell 42. In some advantageous embodiments of the present connector, the retaining ring 112 may comprise a shape memory alloy and be configured to be heat releasable in the same manner as is described above with reference to the retaining ring 102 in the receptacle shell 30. Both retaining rings 102, 112, may, if desired, be gold plated to increase their resistance to corrosion in the presence of sea water.

The shoulder 168 may include a break to form a keyway 174 which receives a key 178 (also visible in FIG. 6) formed on the exterior of the plug insert 46. A groove 180 formed in the integral surface of the forward end of the plug shell 42 receives an O-ring, designated 128 in FIG. 7, to provide a seal between the interior wall of the plug shell 42 and plug insert 46. The location of the key 178 and keyway 176 is such that the plug insert 46 may be freely rotated to align and insert the key 178 into the keyway 176 prior to contact between the forward end of the insert with the O-ring in the groove 180. This enables the plug insert to be easily oriented with respect to the keyway 176 prior to frictional engagement with the O-ring.

As mentioned above, the exterior surface of the forward section of the plug shell 42 includes a key 166 thereon which engages a keyway 164 formed in the receptacle shell 30. Preferably, the key 166 defines a flat surface which is substantially tangential to a point on the contoured outer surface of the plug shell. One embodiment of such a key is shown in FIG. 9*b*, wherein the key 166 has a flat upper surface which is tangential to the cylindrical outer surface of the forward section of the plug shell 42. That is, a portion 167 of the key 166 is flush with the outer surface of the plug shell 42. Preferably, the key 166 and the plug shell are machined from a single piece of material. As illustrated and described with reference to FIG. 8*b*, the keyway 164 is similarly formed so that the exterior diameter of the receptacle shell 30 in the region of the keyway 164 can be made as small as possible while still retaining sufficient wall thickness.

Figure 10A:
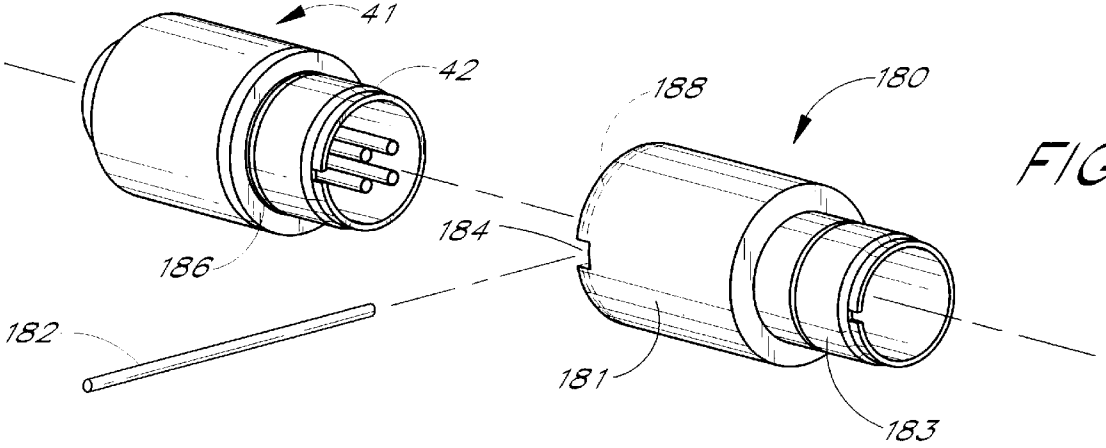
FIG. 10*a* is a perspective view of a rear adaptor configured to removably attach to the connector plug portion of FIG. 4.
Figure 10B:
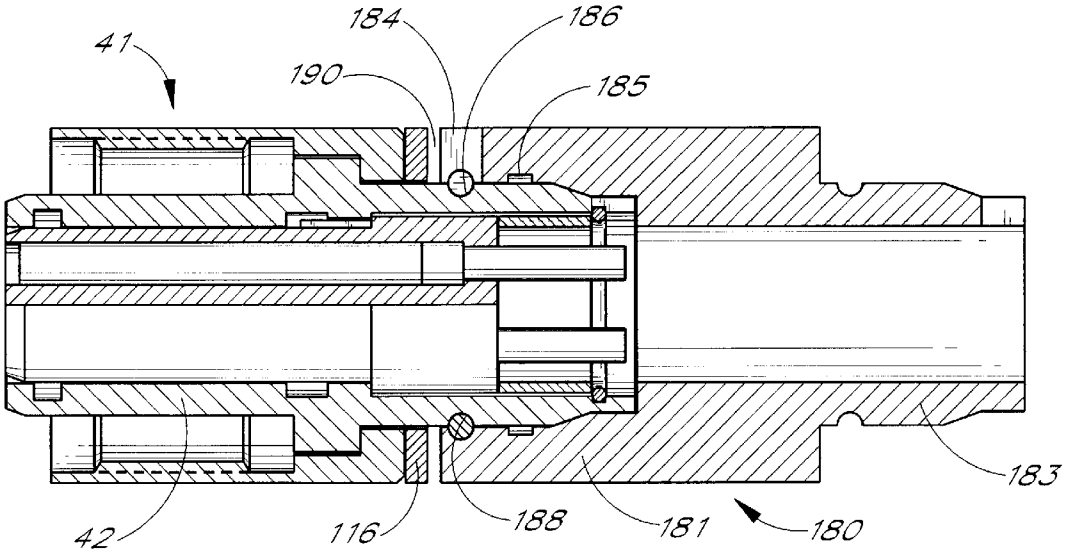
FIG. 10*b* is a cross sectional view of the rear adapter and connector plug portion of FIG. 10*a* when attached.

Another aspect of the present invention comprises an adaptor 180 which is made to couple to the rear end of the plug portion 41, as seen in perspective in FIG. 10*a*. The adaptor 180 is also shown in cross-section in FIG. 10*b* attached to the rear portion of the plug shell 42, which Figure illustrates one advantageous means of attaching the adaptor to the rear end of the plug shell 42. As can be seen in FIG. 10*b*, the rear adapter comprises a hollow shell which may be machined from a solid piece of titanium or other suitable material. The front end 181 of the rear adapter 180 defines an inner diameter so as to slidably fit over the rear portion of the plug shell 42. The rear end 183 of the adapter 180 preferably has an outer diameter which is approximately equal to the inner diameter of the front portion. Most preferably, the rear portion is machined to have a configuration which is essentially identical to the configuration of the rear portion of the plug shell 42.

Referring to FIG. 10*b* as well as 10*a*, the plug shell 42 includes a circumferential groove 186 in its rear portion. The rear adapter 180 includes a first circumferential groove 185 for seating an elastomeric O-ring to create a water-tight seal, and also includes a circumferential groove 188 on the inside surface of its front portion 181. The circumferential grooves are axially positioned so that when the front portion of the rear adapter 180 is placed over the rear portion of the plug shell 42, the two grooves 186, 188 may be positioned in an opposed relation, as seen most clearly in FIG. 10*b*. The rear adaptor 180 is held in place with a flexible retaining pin 182 which is inserted through a notch 184 so as to slide into the facing grooves 186, 188 of the rear adaptor 180 and plug shell 42.

The pin 182 is seen as a straight rod prior to insertion in FIG. 10*a*. In use, the pin 182 is inserted through the notch 184 formed in the forward end of the rear adaptor 180 which communicates with the groove 188 in the rear adapter 180. The pin 180 is thus fed through the opposed grooves 186, 188, so as to extend substantially around the circumference of the joint. The length of the pin is sufficient to firmly couple the two parts together, while leaving one end or tail extending out of the notch 184. This tail is then bent out of the way into the open space 190 between the retaining ring 116 at the back of the plug shell 42 and the front of the rear adaptor 180. In some advantageous embodiments, the pin 182 is constructed from a shape memory alloy to make removal easier. In this embodiment, the portion of the pin 182 which has been pushed into the open space 190 is heated until the tail returns to its original straight configuration and pops out of the open space 190 so that it can be easily grasped to remove the pin 182 from the opposed grooves 186, 188.

As mentioned above, the rear adaptor 180 comprises a rear section 183 which is configured to be substantially identical to the rear section of the plug shell 42. As is well known to those in the art, the rear portion of the plug shell 42 is often configured in various styles depending on the connector application. For instance, the rear portion may include a 90° bend. It may include an oil inlet hole for use in a pressure balanced oil filled system. Different cable terminations such as armored or potted may be provided. Adaptation for field testability may also be incorporated into a plug shell rear portion.

The creation of custom configurations comprising a combination of options is thus much easier with the rear adaptor 180 of the present invention. Because the rear portion 183 of the rear adaptor 180 is configured to be substantially identical to the rear portion of the plug shell 42, a second rear adaptor, or even a chain of several rear adaptors, can be serially connected to a single plug shell. Thus several different termination options can be provided without having to design and manufacture a custom connector.

Figure 11A:
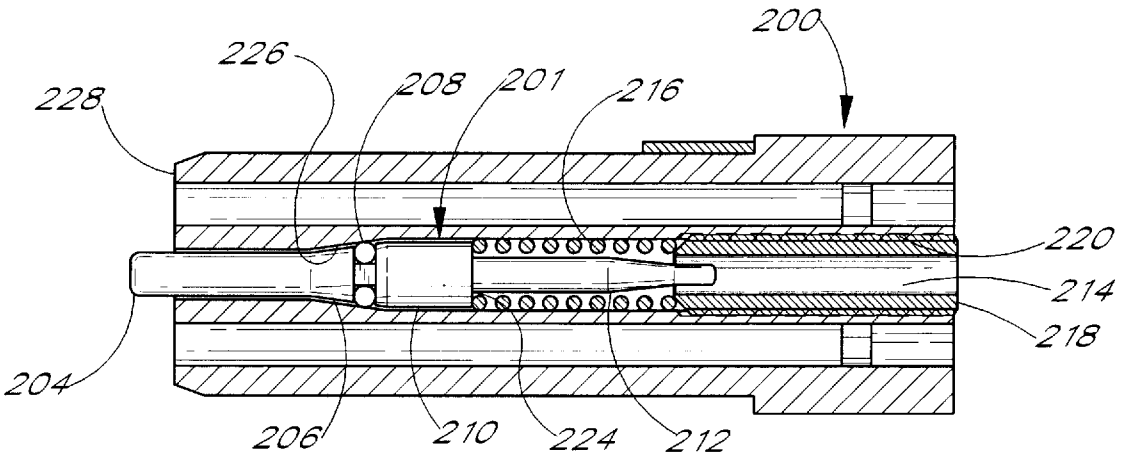
FIG. 11*a* is a cross-sectional view of an alternative insert for a connector plug portion having a central spring-biased oil valve therein.
Figure 11C:
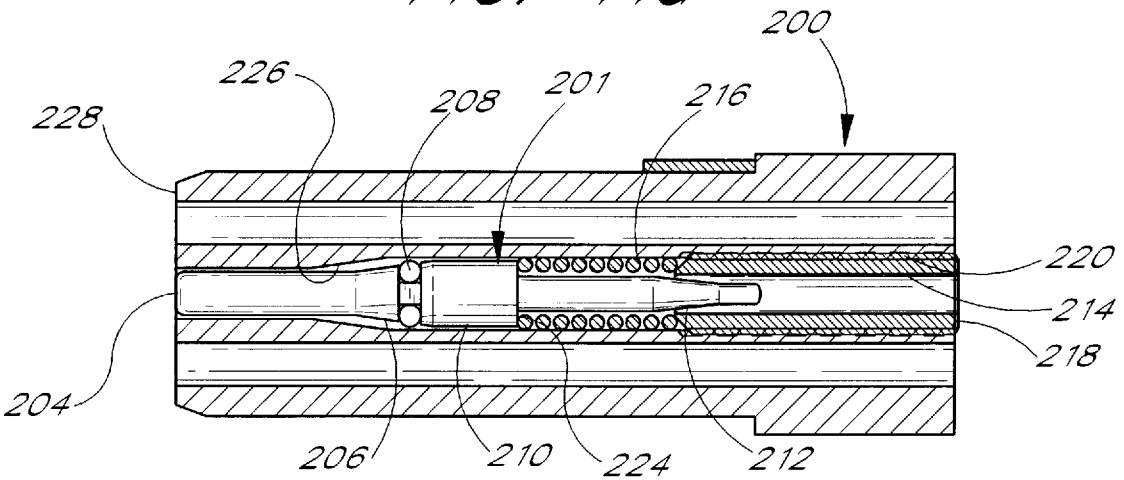
FIG. 11*c* is a cross-sectional view of the insert of FIG. 9*a* showing the oil valve displaced so as to allow flow of oil therethrough.
Figure 11B:
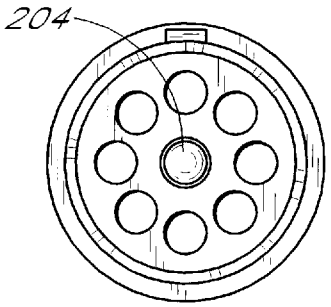
FIG. 11*b* is a front elevational view of the insert of FIG. 11*a*.

Referring now to FIGS. 11*a* and 11*b*, it may be recalled that reference has been made above to pressure balanced oil filled cable/connector interfaces which are sometimes utilized in underwater applications. In these interfaces, it can be desirable to allow the oil in the cable harness to flow from the cable, through the plug insert body, and into the area where the contact between the pins of the receptacle shell and the sockets of the plug shell is made. One aspect of the present invention thus includes a valve in the insert, which allows this flow only when the receptacle and plug portions of the connector are mated. FIGS. 11*a* and 11*b* illustrate a cross section of a plug insert 200 of similar overall configuration as the plug insert 46 previously described, but including an oil valve extending longitudinally therethrough. The plug insert 200 thus includes a throughbore for receiving an oil valve. In many preferred embodiments, the throughbore lies along the central longitudinal axis of the insert 200, but this need not be the case, as an offset positioning may also be utilized if desired.

The body 201 of the oil valve preferably comprises a forward nose portion 204, a tapered neck 206 having an O-ring 208 positioned concentrically therein, and a central body portion 210. In addition, a rearwardly extending guide pin portion 212is surrounded by a spring 216. As can be appreciated with examination of FIG. 11*c*1, when the spring is compressed with pressure on the nose portion 204 of the valve body 201, the rearwardly extending guide pin portion 212 extends further into a channel 214 formed within a retaining sleeve 218 in the rear portion of the throughbore. The retaining sleeve 218 may be externally threaded so as to fasten within a tapped portion 220 of the rear end of the throughbore. This feature allows the entire valve assembly to be easily removed from the insert 200 if desired by simply unthreading the retaining sleeve 218 until it is out of the throughbore, and then sliding the rest of the components out the rear of the insert 200.

In operation, the spring 216 acts between the retaining sleeve 218 and a rear stop face 224 of the central body portion 210 of the valve body 201 to force the O-ring 208 against a tapered inner surface 226 of the throughbore. In its relaxed position, the spring 216 forces the nose 204 forwardly past the front face 228 of the plug insert 200. This configuration is illustrated in FIG. 11*a*.

FIG. 11*c* illustrates the plug insert 200 with the oil valve 201 displaced to the right until the nose 204 of the valve body 201 is flush with the front face 228 of the insert 200. In this configuration, oil is allowed to pass from the rear of the insert 200 to the front of the insert 200. That is, oil may now flow from the oil filled cable harness, through retaining sleeve 218, around the guide pin portion 212 and main body 210, and past the now unseated O-ring 208 and nose portion 204.

It can be appreciated that when the plug portion of a connector containing an oil valve 201 as described above is seated in a receptacle shell portion of a connector (as is illustrated in FIG. 7 and described in detail above), the front face 208 of the plug insert 200 will contact the front face of the insert in the receptacle shell. This will displace the nose portion 204 of the oil valve 201, thus opening the valve and allowing oil flow upon connector mating.

Underwater connectors according to the present invention thus include several advantages over underwater connectors previously available. One significant feature is their small size, which allows increased bulkhead connector densities. Prior to the present invention, modular connectors less than about one inch in diameter were considered unworkable by those of skill in the art. The connectors of the present invention include insert retainers which are easier to remove than those found in the prior art. Keys and keyways have been created which retain wall strength without requiring an undesirable wall thickness. Furthermore, an insert oil-valve which is removeable, more compact, and simpler than prior art devices is also provided. It will be appreciated by those of skill in the art that although the benefits of the above described features are most dramatic for small connectors, they are applicable to connectors of any size.

In addition, underwater connectors according to some embodiments of the present invention include improved flexibility in use. For example, some preferred connector configurations described above include provision for alternative threaded or flange mounting to a bulkhead with the same connector shell. In addition, a removeable rear adaptor allows a wide variety of alternative cable termination configurations without requiring the creation and stocking of a large number of different connector shells.

The foregoing description details certain preferred embodiments of the present invention and describes the best mode contemplated. It will be appreciated, however, that no matter how detailed the foregoing appears in text, the invention can be practiced in many ways. As is also stated above, it should be noted that the use of particular terminology when describing certain features or aspects of the present invention should not be taken to imply that the broadest reasonable meaning of such terminology is not intended, or that the terminology is being re-defined herein to be restricted to including any specific characteristics of the features or aspects of the invention with which that terminology is associated. The scope of the present invention should therefore be construed in accordance with the appended claims and any equivalents thereof.

What is claimed is:

1. A connector for underwater use, comprising:

a plug portion comprising a plug shell and a removeable plug insert;

a receptacle portion comprising a receptacle shell and a removeable receptacle insert;

a first retainer for retaining said removeable plug insert in said plug shell; and a second retainer retaining said socket insert in said socket shell, wherein said first retainer and said second retainer are formed at least in part from a shape-memory-alloy.

2. The connector of claim 1, wherein said plug shell and said socket shell both have a maximum diameter of less than approximately 0.75 inches.

3. The connector of claim 2, wherein said shape-memory-alloy is substantially inert in seawater.

4. The connector of claim 2, wherein said retainers are plated with gold.

5. The connector of claim 1, wherein said plug shell comprises a first channel, said receptacle shell comprises a second channel, wherein said first retainer and said second retainer comprise retaining rings, and wherein said first and said second retaining rings are seated in said first and said second channels respectively.

6. The connector of claim 5, wherein said retaining rings comprise shape-memory-alloy.

7. The connector of claim 6, wherein said shape-memory-alloy is substantially inert in seawater.

8. The connector of claim 1, wherein said receptacle shell comprises a keyway and said receptacle insert comprises a key.

9. The connector of claim 8, wherein said receptacle insert defines a contoured outer surface, and said key defines a flat surface which is substantially tangential to a point on said contoured outer surface.

10. A connector for underwater use, comprising first and second mateable shells, wherein at least one of said shells comprises an insert contained substantially within said at least one of said shells, and a retainer holding said insert within said at least one of said shells, wherein said retainer comprises shape-memory-alloy.

11. The connector of claim 10, wherein said shape-memory-alloy comprises an alloy selected from the group consisting of Zn—Al, Cu—Al—Ni, and Ni—Ti.

12. The connector of claim 10, wherein said retainer comprises a split retaining ring, and wherein said receptacle comprises a groove for receiving said retaining ring.

13. The connector of claim 12, wherein said split retaining ring has a natural diameter which is smaller than its diameter when pressed into said groove.

14. A connector for underwater use, comprising:

a plug portion, wherein said plug portion comprises (1) a first shell, (2) a first insert contained substantially within said first shell, and (3) a first retainer holding said first insert within said first shell, wherein said first retainer comprises shape-memory-alloy; and a receptacle portion mateable with said plug portion, wherein said receptacle portion comprises (1) a second shell, (2) a second insert contained substantially within said second shell, and (3) a second retainer holding said insert within said second shell, wherein said second retainer comprises shape-memory-alloy.

15. The connector of claim 14, wherein said first shell comprises a first channel, said second shell comprises a second channel, wherein said first retainer and said second retainer comprise retaining rings, and wherein said first and said second retaining rings are seated in said first and said second channels respectively.

16. A plug shell for an underwater connector, comprising:

a shell body having a contoured outer surface; and a key defining a flat surface on said contoured outer surface, wherein said flat surface is substantially tangential to a point on said contoured outer surface.

17. The shell of claim 16, wherein said contoured outer surface is substantially cylindrical.

18. The shell of claim 16, wherein said insert body and said key are machined from a single piece of material.

19. An underwater connector comprising a shell and an insert retained inside said shell, said insert further comprising:

a throughbore having a threaded section proximate a rear end of said insert;

an externally threaded sleeve within said throughbore which is threadably engaged with said threaded section of said throughbore;

a valve body within said throughbore having an O-ring placed thereon;

a spring captured by and extending between said valve body and said threaded sleeve; and wherein said throughbore includes a tapered portion reducing a diameter of said throughbore from a first diameter proximate said rear end of said insert to a second smaller diameter proximate a front end of said insert, and wherein said spring biases said valve body toward said front end of said insert so as to seat said O-ring against said tapered portion.

20. The insert of claim 19, wherein the length of said valve body is such that a front portion of said valve body extends beyond said front end of said insert when said O-ring is seated against said tapered portion.

21. An underwater connector, comprising:

a plug shell;

a receptacle shell;

a plug insert, wherein said plug insert is retained inside said plug shell with a retaining ring comprising a shape-memory alloy;

a receptacle insert, wherein said receptacle insert is retained inside said receptacle shell with a retaining ring comprising a shape-memory alloy;

a key on an outside surface of said plug shell, said key having a portion which is flush with said outside surface of said plug shell; and a keyway on an inside surface of said receptacle shell, said keyway being configured to slidably accept said key as said receptacle shell and said plug shell are mated.

22. The underwater connector of claim 21, wherein said plug shell and said receptacle shell both have a maximum diameter of less than approximately 0.75 inches.

23. The underwater connector of claim 21, wherein said receptacle shell comprises a threaded rear portion for mounting said receptacle shell to a bulkhead.

24. The underwater connector of claim 23, wherein said receptacle shell additionally comprises a collar located on an outer surface of said receptacle shell, and wherein said connector additionally comprises a removeable flange, configured to clamp said collar to a bulkhead wall.

25. The underwater connector of claim 21, additionally comprising a rear adaptor removeably secured to a rear portion of said plug shell.

26. The underwater connector of claim 25, additionally comprising a second rear adaptor removeably secured to a rear portion of said rear adaptor.

27. The plug shell of claim 16, wherein the key defines a first side and a second side which respectively connect to opposing ends of the flat surface at a substantially 90 degree angle, the first and second sides extending from the flat surface to the contoured outer surface.

* * * * *